US006161604A

United States Patent [19]

Richards et al.

[11] Patent Number: 6,161,604

[45] Date of Patent: Dec. 19, 2000

[54] WEB-UP APPARATUS AND METHOD

[75] Inventors: John Sheridan Richards, Barrington; David Clarke Pollock, Somersworth, both of N.H.

[73] Assignees: Heidelberger Druckmaschinen AG; Heidelberg Harris, Inc.

[21] Appl. No.: 08/427,018

[22] Filed: Apr. 24, 1995

[51] Int. Cl.[7] ..... B65H 21/00

[52] U.S. Cl. ..... 156/504; 156/509; 156/510; 242/422; 242/596; 242/596.4

[58] Field of Search ..... 156/504, 509, 156/510; 242/596, 596.4, 422

[56] References Cited

U.S. PATENT DOCUMENTS

| | | | |
|---|---|---|---|
| 2,859,923 | 11/1958 | Bowen | 242/422 |
| 4,161,298 | 7/1979 | Davis | 242/67.1 |
| 4,211,375 | 7/1980 | Weiss et al. | 242/596 |
| 5,039,374 | 8/1991 | Winter | 156/504 |
| 5,110,063 | 5/1992 | Koepe | 242/78.1 |

FOREIGN PATENT DOCUMENTS

| | | |
|---|---|---|
| 324 707 | 7/1989 | European Pat. Off. . |
| 1 460 005 | 12/1976 | United Kingdom . |
| 1 488 510 | 10/1977 | United Kingdom . |
| 2 053 863 | 2/1981 | United Kingdom . |
| 2 121 386 | 12/1993 | United Kingdom . |

*Primary Examiner*—Linda L. Gray
*Attorney, Agent, or Firm*—Kenyon & Kenyon

[57] ABSTRACT

A web-up system is provided for a web-fed printing press, the web fed printing press having a plurality of components including a slitter mechanism. The web-up system includes either or both a web-up device and a ribbon winder. The web-up device is located adjacent to an output of a first component of the web-fed printing press, the first component located upstream from the slitter mechanism. The web-up device includes a splicing mechanism and a secondary web roll rotatably mounted on a shaft. The splicing mechanism receives a first web of material from the first component, receives a second web of material from the secondary web roll, splices the first web of material to the second web of material, and outputs a spliced web of material to the next downstream component of the press, e.g., the slitter mechanism. The ribbon winder is coupled to an output of the slitter mechanism. The slitter mechanism slits the web of material into at least a first and second ribbon. The ribbon winder includes a roller for receiving the second ribbon. The roller maintains a substantially constant tension in the second ribbon by winding said second ribbon around an outer surface of the roller.

10 Claims, 2 Drawing Sheets

WEB-UP APPARATUS AND METHOD

FIELD OF THE INVENTION

The present invention relates to the field of web-up devices and methods for rotary printing presses.

BACKGROUND OF THE INVENTION

In a web-fed rotary printing press, a web of material is fed from a roll stand, through an infeed, then through one or more printing units, a dryer, and a chill roll stand before being cut into a plurality of ribbons by a slitter mechanism. The ribbons, in turn, are fed through an angle bar section, and then into a cutting/folding cylinder section of a folder.

When a web is initially fed through the press (called "web-up"), it is fed sequentially from the roll stand through to the folder. This process generally involves two people manually feeding the web through each component of the press system up to the entrance of the slitter mechanism. Once the web reaches the slitter mechanism; additional personnel are required to process the ribbons, e.g. two additional people per ribbon.

The web-up process is therefore slowed because the web must be first fed through the printing units prior to being fed into the dryer, and must be fed through the dryer and chill unit prior to being fed through the slitter. Moreover, once the web is cut into multiple ribbons by the slitter, additional personnel are needed to process the multiple ribbons. Since the web-up process adversely affects productivity by causing significant down-time for the printing press, a need exists to reduce the time required for web-up.

SUMMARY OF THE INVENTION

In accordance with the present invention, a web-up system for a web-fed printing press is provided. The web-up system according to the present invention may include either or both a web-up device and a ribbon winder. The web-up device according to the present invention allows multiple sections of a press system to be webbed up concurrently and the ribbon winder according to the present invention eliminates the need to provide additional personnel to web-up a post-slitter portion of a printing press (i.e., the components located downstream of the slitter mechanism). By providing a web-up system including both the web-up device according to the present invention and the ribbon winder according to the present invention, it is possible to simultaneously web-up a pre-slitter section of a press and the post-slitter section of the press using only two sets of two technicians. As a result, the web-up system according to the present invention not only reduces the time required for web-up, but also reduces the number of personnel required to accomplish web-up of the post-slitter section of the press.

In accordance with a first embodiment of the present invention, a web-up device is located adjacent to an output of a first component of the web-fed printing press, wherein the first component is located upstream from the slitter mechanism. In a conventional web-offset printing press, the web-up device could be located, for example, after the printing units, after the dryer, or after the chill unit. The web-up device comprises splicing mechanism and a secondary web roll rotatably mounted on a shaft. The splicing mechanism receives a first web of material from an adjacent upstream component of the press and receives a second web of material from the secondary web roll. The splicing mechanism then splices the first web of material to the second web of material and outputs a spliced web of material to an adjacent downstream component of the press. For example, if the web-up device were located between the chill unit and the slitter mechanism, the first web of material would be received from the output of the chill unit, the second web of material would be received from the secondary web roll, and the spliced web of material would be output to the slitter mechanism.

By providing the web-up device according to the present invention in one or more locations in the printing press, web-up time of the press is substantially reduced because web-up can proceed simultaneously in several parts of the press. For example, if the web-up device is located between the chill unit and the slitter mechanism, one set of technicians can feed a first web from the roll stand through to the chill unit of the press while a second set of technicians feeds the second web from the secondary web roll through the slitter mechanism and folder of the press. Then, once the first web has reached the output of the chill roll, the splicing mechanism splices the first web to the second web thereby forming a single continuous web from the roll stand through the folder.

In accordance with a second embodiment of the present invention, the splicing mechanism of the web-up device further includes a splice adhesive applicator for applying an adhesive to the second web of material, a nip for receiving the first web of material from the upstream component and the second web of material from the secondary web roll and pressing the second web of material against the first web of material; and a web severer mounted between the splice adhesive applicator and the nip, the web severer cutting the second web of material after the first web has been spliced to the second web.

In accordance with a third embodiment of the present invention, the web-up system includes a ribbon winder for coupling to an output of the slitter mechanism. As set forth above, the slitter mechanism slits a web of material into at least a first and second ribbons. The ribbon winder includes a roller for receiving the second ribbon and the roller maintains a substantially constant tension in the second ribbon by winding the second ribbon around an outer surface of the roller. In accordance with a further embodiment of the present invention, the slitter mechanism slits the web into n ribbons and the ribbon winder includes n-1 rollers. Each roller is mounted to a live shaft via a torque-limiting coupling and is driven by a constant torque drive in order to maintain a substantially constant tension in its respective ribbon. Moreover, the rollers are removable in order to accommodate varying numbers of ribbons. In addition, the axial position of each roller on the live shaft is adjustable to accommodate various ribbon configurations.

By providing the ribbon winder in accordance with the present invention, alone or in combination with the web-up device according to the present invention, the number of technicians needed to web-up the press from the slitter mechanism through to the folder is reduced. As set forth above, in a conventional system, once the web is slit into a plurality of ribbons by the slitter mechanism, additional technicians are needed to process the multiple ribbons as they exit the slitter mechanism. In accordance with the ribbon winder of the present invention, while a first ribbon is webbed through the folder of the press, the remaining ribbons are wrapped around respective rollers which are driven to maintain a substantially constant ribbon tension. Once the first ribbon has been webbed through the folder, each of the remaining ribbons is, in turn, severed from its respective roller and webbed through the folder while tension is maintained in any remaining un-webbed ribbons. In this manner, the need for additional technicians is eliminated.

In accordance with the present invention, a method for webbing up a web-fed printing press is also provided. The method comprises the steps of feeding a primary web of material through a first set of press components (e.g. the printing units, dryer, and chill unit); feeding a secondary web of material from a secondary web roll through a second set of components (e.g. the slitter mechanism and folder); adhering the primary web of material to the secondary web of material at a point between the secondary web roll and the second set of components; and cutting the secondary web of material after the adhering step.

DETAILED DESCRIPTION OF THE INVENTION

Figure 1:
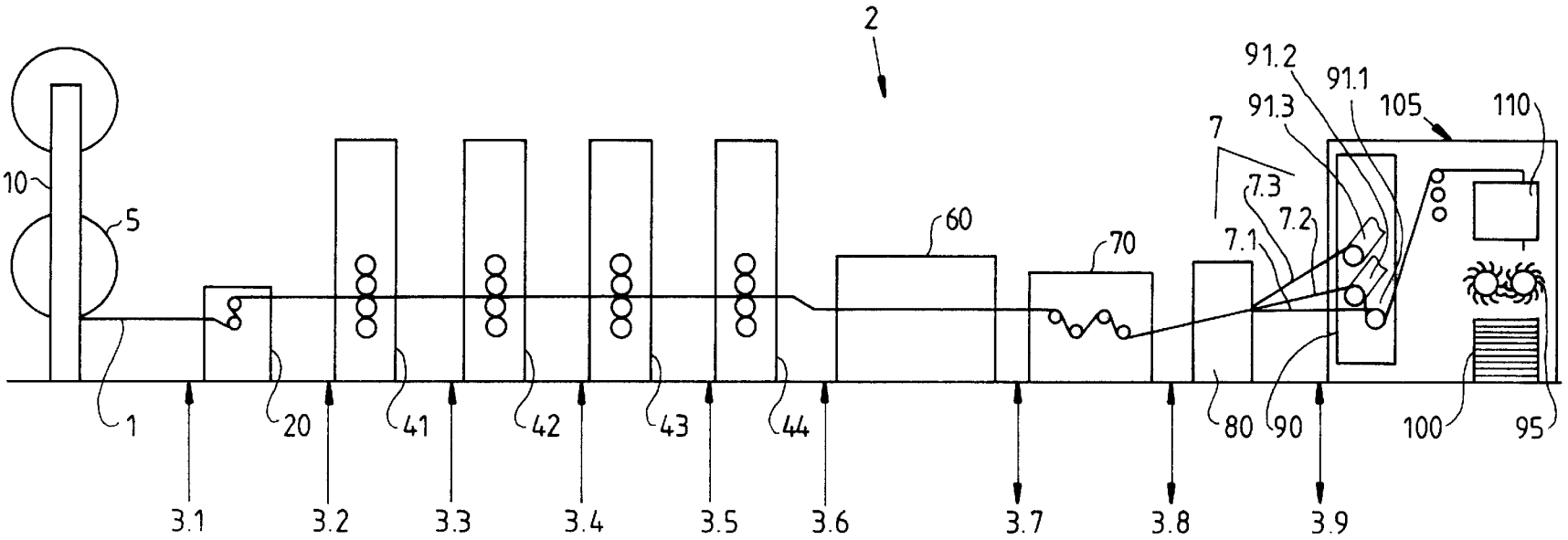
Fig.1 Prior Art
FIG. 1 shows an illustrative prior art printing press.

FIG. 1 shows a conventional web-offset lithographic printing press 2, including a roll stand 10, an infeed 20, a first printing unit 41, a second printing unit 42, a third printing unit 43, a fourth printing unit 44, a dryer 60, a chill unit 70, a slitter mechanism 80, and a folder 105 including an angle bar section 90, a cutting/folding cylinder section 110, a fan blade section 95 and stacking mechanism 100.

At web-up, a web of paper 1 is pulled off of a web roll 5 by two technicians positioned at location 3.1 and is manually fed into an infeed 20. Then, the two technicians move sequentially through locations 3.2, 3.3, 3.4, and 3.5 to manually feed the web 1 though each of the printing units 41–44. After this task is complete, the technicians must move to location 3.6 to manually feed the web 1 through the dryer 60, and then to location 3.7 to manually feed the web 1 through the chill roll stand 70, and then to location 3.8 to manually feed the web 1 through the slitter mechanism 80.

The slitter mechanism 80 cuts the web 1 into a plurality of ribbons 7. Each ribbon 7 must be fed through the angle bar section via a separate path. For example, ribbon 7.1 may need to be fed through roller 91.1, ribbon 7.2 through roller 91.2, and ribbon 7.3 through roller 91.3. As a result, a total of 4 technicians are needed simultaneously at location 3.9 in order to handle the three ribbons 7.1–7.3; two technicians to take up the slack in the first two ribbons, and two technicians to web the remaining ribbon through the folder 105.

In accordance with the present invention, the time required for web-up of a printing press is greatly reduced by allowing web up to proceed at several points in the printing press simultaneously.

Figure 2:
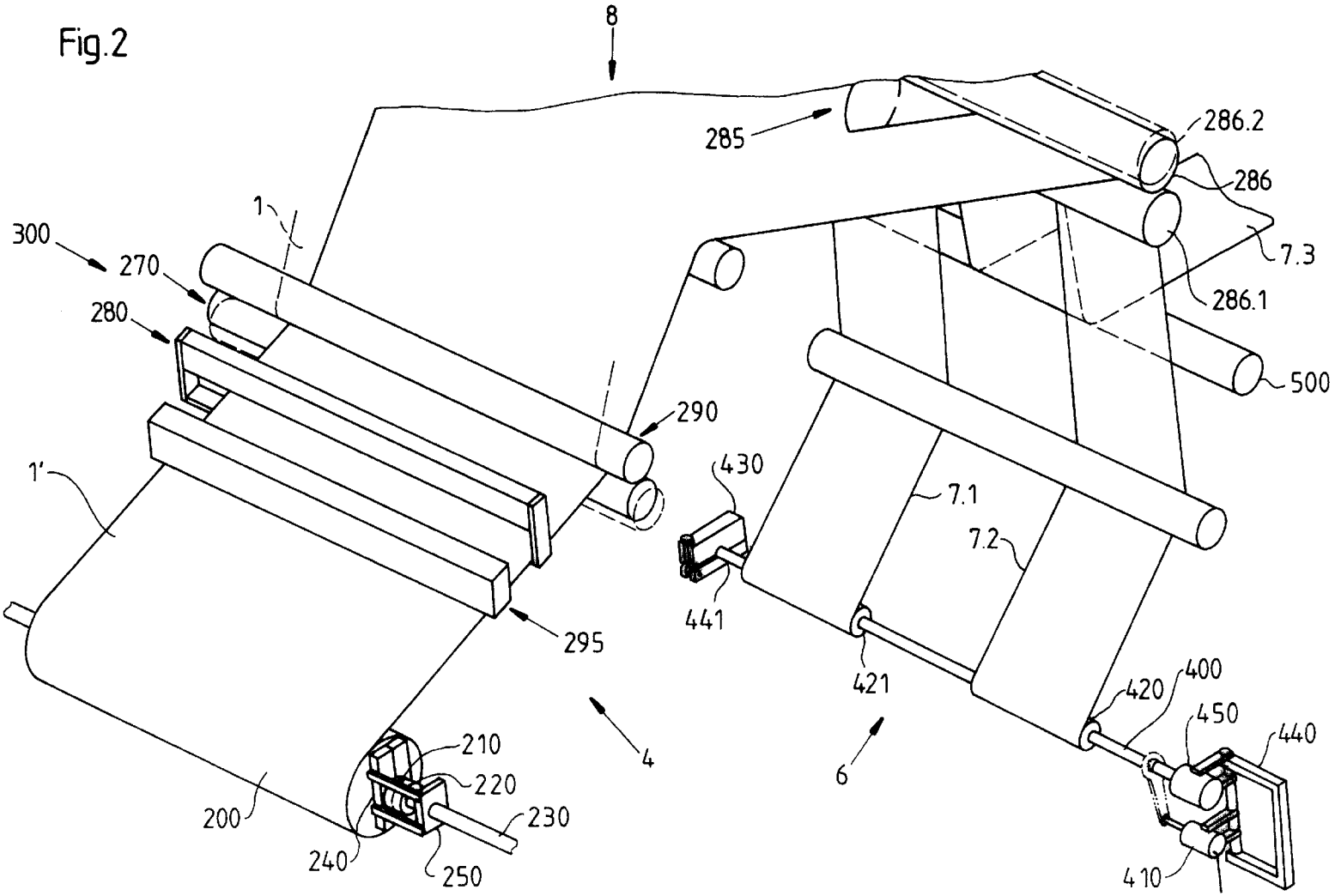
FIG. 2 shows a web-up system according to the present invention including a web-up device and a ribbon winder.

FIG. 2 shows a web-up system 8 according to an illustrative embodiment of the present invention including a web up mechanism 4 and a ribbon winder 6.

The web-up mechanism 4 includes a secondary web roll 200, which is spliced with an incoming web 1 from an upstream device at a splicing mechanism 300. The web-up mechanism 4 can be mounted in various locations in the printing press; for example, at position 3.9 before the slitter mechanism 80, at position 3.6 before the dryer 60, and/or at position 3.7 before the chill unit 70. In FIG. 2, the web-up mechanism is shown mounted just prior to the slitter mechanism 80.

By mounting the web-up mechanism 4 in one or more locations in the printing press 2, web-up time is greatly reduced because web-up can proceed in parallel. For example, if the web up mechanism 4 is mounted just prior to the slitter 80, a first team of two technicians can feed the web 1 from web roll 5 through the infeed 20, printing units 41–44, dryer 60, and chill unit 70, while a second set of two technicians simultaneously feed the web 1' from the replacement roll 200 through the slitter mechanism 80, the angle bar section 90, and into the folder cylinder section 110. When the web 1 exits the chill unit 70, it is fed through the splicing section 300 and adhered to the web 1' with an adhesive. Then, the web 1' is cut by the splicing section 300 completing the splice and creating a single continuous web from the roll stand 10 through the folder 105. Web-up time can be further reduced by providing additional web-up mechanisms 4 at other points in the printing press, thereby allowing three or four sets of technicians to work in parallel.

The web up mechanism 4 of FIG. 2 will now be described in more detail. The web roll 200 is held in chucks 210 which are mounted on bearings 220 on a dead shaft 230 with a tensioning 240 and brake mount 250. The tensioning 240 and brake mount 250 prevents the roll 200 from coasting. If the roll 200 were to coast, this could cause slack to develop in the web 1'. A slack web 1', in turn, could drift toward the frame of the printing press and tear.

At web-up, the web 1' is fed through a splice adhesive applicator 295 and a roll severer 280 before being fed into a nip between guide roller 290 and pressure roller 270. The web 1' is then fed into the slitter mechanism 80. Referring to FIG. 2, the slitter mechanism 80 is, for simplicity, illustrated as slitter blades 285 (only one shown) and slitter exit nip 286. When the incoming web 1 is received from the chill unit 70, the pressure roller 270 is displaced downward, and the incoming web 1 is wrapped around guide roller 290. The pressure roller 270 is then returned to its original position. Then, as the nip between the rolls 270, 290 drive the webs 1, 1', the splice adhesive activator 295 is activated and an adhesive is applied to the web 1'. As the web 1' is pressed against the web 1 at the nip between rollers 270, 290, the web 1' is adhered to the web 1. At a predetermined time (or web length) after activation of the splice adhesive activator 295, the roll severer 280 is activated, the web 1' is cut, and the splice of web 1 to web 1' is complete. Once the spliced portion of the web has made its way through the remainder of the press, it is discarded, and web-up is complete.

Lead-in devices (not shown), such as belts or chains, can be provided to lead the web 1 into the nip 270, 290, and/or to lead the web 1' to the slitter mechanism 80 (or other downstream component). Alternatively, the webs 1, 1' can be manually lead into the nip 270, 290 and/or to the slitter mechanism 80 (or other downstream component) as shown in FIG. 2.

Referring to FIG. 2, the ribbon winder 6 according to the present invention is mounted just after the slitter mechanism 80 (illustrated as components 285,286). The ribbon winder 6 includes a live shaft 400. The live shaft 400 is driven independently of the press 2 by a constant torque device 410. Ribbon rollers 420, 421 are mounted on the live shaft 400 via a torque-limiting (or controlled slip) coupling. As one of ordinary skill in the art will appreciate, such a coupling allows the rollers 420 and 421 to rotate at different angular rates. The live shaft 400 is mounted to an adjacent machine frame (e.g., the frame for the slitter) in bearing 450 on a pivot mounting 440 so that the free end 441 of the live shaft 400 may be moved clear of the machine frames of the press 2 for mounting and removal of the rollers 420, 421 and for removal of excess ribbon. The free end 441 of the live shaft 400 is mounted in a quick release bearing 430.

During make-ready, as the ribbons 7 exit the slitter mechanism 80, each of the ribbons 7 is fed through a separate roller path through the rest of the press. Typically, there is a driven roll with an opposing nip just downstream (rollers 286) of the slitter blades 285 that keep the web sufficiently tensioned for slitting. If the ribbons downstream of the nip 286 are allowed to go slack, there is a tendency for the ribbons 7 to wrap around the driven roll 286.1 resulting in additional delay. As a result, without the ribbon winder 6 according to the present invention, there is a need for at least one additional person per ribbon; i.e. two people web-up the first ribbon through the rest of the press while at least one additional person is needed for each of the other webs in order to take up the slack in these other webs to prevent wrapping. In the illustration of FIG. 1, in which there are 3 ribbons, two technicians would be needed to web-up ribbon 7.3, and two additional technicians would be needed to manually take up the slack in ribbons 7.1 and 7.2.

In accordance with the ribbon winder of the present invention, the need for additional personnel in eliminated. As the ribbons 7 exit the slitter mechanism 80 and the nip 286, ribbons 7.1 and 7.2 are attached to rolls 420 and 421 and the constant torque drive 410 is activated. Then, as the web 1 is advanced in order to allow the technicians to feed the ribbon 7.3 through the rest of the press, via for example, roller 500, the constant torque drive 410 maintains a constant tension in ribbons 7.1, 7.2 by winding the ribbons around the rolls 420, 421. After ribbon 7.3 has been fed through the rest of the press, ribbon 7.2 is cut. Then the technicians feed ribbon 7.2 through the rest of the press while the constant torque drive continues to wrap ribbon 7.1 around the roller 421. After ribbon 7.2 has been fed through the rest of the press, ribbon 7.1 is cut and fed through the rest of the press. Once ribbon 7.1 has been cut, the quick release bearing 430 is opened and the rollers 420, 421, which hold the excess ribbon, are removed.

The axial position of the rollers 420, 421 can be adjusted along the length of the live shaft 400 to accommodate different ribbon arrangements. Moreover, additional rollers can be added to accommodate additional ribbons.

The use of the web-up mechanism and ribbon winder of the present invention, alone or in combination, simplifies the web-up process considerably. As an illustration, assume a web break has occurred in the printing press 2 during high speed operation and all of the paper is lost from the infeed 20 to the folder 105. Moreover, scraps of paper have been found in an inker roll of one of the printing units 41–44. Therefore, it will take some time to clean out the printing unit before it can be re-webbed.

In accordance with the present invention, rather than waiting for the printing unit to be cleaned out, two people, using a web up mechanism 4 according to the present invention located just prior to the slitter mechanism 80 at location 3.8, can begin to web-up the rest of the components 80 and 105 downstream.

Specifically, while a first set of technicians are cleaning out the printing unit, a second set of technicians feed the web 1' through the splicing section 300 into the slitter mechanism 80 (components 285, 286). Ribbons 7.1 and 7.2 are attached to rollers 420, 421 of the ribbon winder 6, and the constant torque drive 410 is activated. Then, the ribbon 7.3 is fed through the angle bar section 90 and through the rest of the folder 105. Once ribbon 7.3 has been webbed, ribbon 7.2 is cut, and fed through the angle bar section 90 and through the rest of the folder 105. The same process is then repeated for ribbon 7.1.

Once the first set of technicians has webbed the web 1 through the chill unit 70, the web 1 is wrapped around the nip 270,290, the splice adhesive applicator 295 is activated, and the web 1' is bonded to the web 1 as they pass through the nip 270, 290. Once web 1 has been bonded to web 1', the web severer 280 cuts the web 1' and the splice is complete, i.e., a single web has been formed throughout the press 2. In this manner, web-up proceeds on two different portions of the press simultaneously, and, in addition, the need for additional personnel to process multiple ribbons is eliminated.

Another illustrative situation in which the present invention will significantly reduce web-up time is during a make-ready in which the paging format of the press is going to be changed from one format to the other. In such a situation, the web will generally have to be slit into a different number of ribbons than in the prior format. Therefore, the slitter mechanism 80 will have to be reconfigured, and, in the folder 105, the angle bars in the angle bar section 90 will need to be moved, and the ribbon cut-off compensator rolls in the ribbon deck (not shown) will need to be reconfigured. To accomplish this, the ribbon must be removed from the slitter mechanism 80 and the folder 105, and these components must be re-webbed. In addition, in order to change the page format of the press, the printing plates in the printing units 41–44 would have to be replaced, thereby necessitating the removal of the web 1 from the printing units 41–44. In accordance with the present invention, rather than waiting for the printing plates to be changed and the web to be fed though the printing units 41–44, the dryer 60, and chill unit 70 prior to webbing up the slitter mechanism 80 and the folder 105, web up of the slitter 80 and folder 105 can proceed concurrently with the web-up of the printing units 41–44.

While the embodiment shown in FIG. 2 shows an automatic splice applicator 295 applying splice tape to the web 1', it should be understood that any method of splicing can be used. For example, the adhesive could be manually applied to the web 1' by a technician. Similarly, while the embodiment of FIG. 2 shows the splice being applied while the web 1' is moving, the present invention applies equally to manual or automatic splicing techniques in which the web 1' is stopped during the splice.

What is claimed is:

1. A web-fed printing press, comprising:

a first print unit, the first print unit receiving a first web of material for printing thereon;

a second component disposed downstream of the first print unit; and a web-up device disposed downstream of the first print unit and adjacent to one of the first print unit and the second component, the web-up device including a splicing mechanism and a secondary web roll rotatably mounted on a shaft, the splicing mechanism receiving the first web of material and also receiving a second web of material from the secondary web roll, the splicing mechanism splicing the first web of material to the second web of material and outputting a spliced web of material to the second component of the web-fed printing press, wherein the second component includes one of a second print unit, a dryer, a chill unit, a slitter and a folder.

2. The web-fed printing press according to claim 1, wherein the shaft of the web-up device is a dead shaft.

3. The web-fed printing press according to claim 2, wherein the web-up device further includes a tensioning brake coupled to the dead shaft.

4. The web-fed printing tress according to claim 3, wherein the secondary web roll of the web-up device is mounted on the dead shaft via chucks mounted on bearings.

5. The web-fed printing press according to claim 1, wherein the splicing mechanism further includes:

a. a splice adhesive applicator for applying an adhesive to the second web of material;

b. a guide roll and a pressure roll which form a nip for receiving the first web of material and the second web of material and pressing the second web of material against the first web of material; and c. a web severer mounted between the splice adhesive applicator and the nip, the web severer cutting the second web of material after the first web has been spliced to the second web.

6. The web-fed printing press according to claim 5, wherein the pressure roll of the web-up device is movable from a first position to a second position, the guide roll and the pressure roll being substantially parallel and in contact in the first position, the guide roll and the pressure roll being substantially parallel and separated in the second position.

7. The web-fed printing press according to claim 1, wherein the splicing mechanism further includes a nip for receiving the first web of material and the second web of material and pressing the second web of material against the first web of material.

8. The web-fed printing press according to claim 7, wherein an adhesive is applied to a portion of the second web prior to the portion of the second web being received in the nip.

9. The web-fed printing press according to claim 8, wherein the adhesive is applied using an automatic splice adhesive applicator.

10. The web-fed printing press according to claim 8, wherein the adhesive is applied manually.

* * * * *